US008818224B2

(12) United States Patent
Tabuchi

(10) Patent No.: US 8,818,224 B2
(45) Date of Patent: Aug. 26, 2014

(54) IMAGE FORMING APPARATUS HAVING A FIXING DEVICE USING AN INDUCTION HEATING METHOD

(75) Inventor: Hidetaka Tabuchi, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 224 days.

(21) Appl. No.: 13/041,232

(22) Filed: Mar. 4, 2011

(65) Prior Publication Data

US 2011/0222889 A1 Sep. 15, 2011

(30) Foreign Application Priority Data

Mar. 9, 2010 (JP) ..... 2010-052023

(51) Int. Cl.
*G03G 15/20* (2006.01)

(52) U.S. Cl.
CPC ..... *G03G 15/2078* (2013.01)
USPC ..... 399/69

(58) Field of Classification Search
USPC ..... 399/69, 330, 335
See application file for complete search history.

(56) References Cited

U.S. PATENT DOCUMENTS

| | | | | |
|---|---|---|---|---|
| 3,942,090 | A * | 3/1976 | Matthes et al. | 363/37 |
| 5,783,806 | A * | 7/1998 | Hayasaki | 219/635 |
| 6,288,378 | B1 * | 9/2001 | Patridge et al. | 219/661 |
| 6,437,302 | B1 * | 8/2002 | Bowers | 219/661 |
| 2002/0011913 | A1 * | 1/2002 | Partridge et al. | 336/182 |
| 2003/0086718 | A1 * | 5/2003 | Birumachi | 399/67 |
| 2004/0173603 | A1 * | 9/2004 | Kinouchi et al. | 219/661 |
| 2005/0029252 | A1 * | 2/2005 | Kinouchi et al. | 219/661 |
| 2005/0067410 | A1 * | 3/2005 | Ring | 219/661 |
| 2005/0173416 | A1 * | 8/2005 | Fukushi et al. | 219/619 |
| 2005/0263521 | A1 * | 12/2005 | Kinouchi et al. | 219/626 |
| 2006/0006169 | A1 * | 1/2006 | Fukushi et al. | 219/619 |
| 2006/0072931 | A1 | 4/2006 | Asakura | |
| 2006/0131301 | A1 * | 6/2006 | Ohta et al. | 219/619 |
| 2006/0147221 | A1 * | 7/2006 | Asakura et al. | 399/69 |
| 2006/0289484 | A1 * | 12/2006 | Kinouchi et al. | 219/619 |
| 2007/0212091 | A1 * | 9/2007 | Kinouchi et al. | 399/69 |
| 2008/0063445 | A1 * | 3/2008 | Imai et al. | 399/333 |
| 2009/0060550 | A1 * | 3/2009 | Seo | 399/69 |
| 2009/0252509 | A1 * | 10/2009 | Yamamoto | 399/44 |
| 2010/0320196 | A1 * | 12/2010 | Tabuchi | 219/660 |
| 2011/0091230 | A1 * | 4/2011 | Yamamoto | 399/69 |

FOREIGN PATENT DOCUMENTS

| | | | |
|---|---|---|---|
| CN | 1751276 | A | 3/2006 |
| CN | 101043768 | A | 9/2007 |
| EP | 1838138 | A1 | 9/2007 |
| JP | 2000-223253 | A | 8/2000 |
| JP | 2002-323829 | A | 11/2002 |

(Continued)

*Primary Examiner* — David Bolduc
(74) *Attorney, Agent, or Firm* — Canon USA, Inc. IP Division

(57) ABSTRACT

A apparatus including a fixing device using an induction heating method includes an induction coil, a resonant capacitor connected to the induction coil, a switching element configured to supply electric power to the induction coil, a driving signal generation circuit configured to determine a frequency of a driving signal for driving the switching element according to electric power to be supplied to the coil and to generate the driving signal, and a setting unit configured to set a minimum frequency of the driving signal according to a temperature of a heating element so that a frequency of the driving signal does not become lower than a resonant frequency determined by an inductance of the induction coil and an inductance of the heating element and a capacitance of the resonant capacitor.

6 Claims, 12 Drawing Sheets

(56) References Cited

FOREIGN PATENT DOCUMENTS

| | | | |
|---|---|---|---|
| JP | 2005-031234 | A | 2/2005 |
| JP | 2008-051951 | A | 3/2008 |
| JP | 2008-287224 | A | 11/2008 |
| JP | 2009-092835 | A | 4/2009 |
| WO | 2004/074944 | A1 | 9/2004 |

* cited by examiner

IMAGE FORMING APPARATUS HAVING A FIXING DEVICE USING AN INDUCTION HEATING METHOD

BACKGROUND OF THE INVENTION

1. Field of the Invention

The present invention relates to an induction heating type fixing device of an image forming apparatus.

2. Description of the Related Art

An electrophotographic type image forming apparatus is generally provided with a fixing device for fixing a toner image transferred onto a recording material such as a paper sheet by applying heat and pressure. As a configuration of the fixing device, a heating method using a ceramic heater or a halogen heater has been conventionally used in many cases. In recent years, however, an electromagnetic induction heating method has been used from a viewpoint of advantages of capability of rapidly generating heat, and the like.

A control of the electromagnetic induction heating type fixing device is performed by driving a switching element for supplying a high-frequency electric current to an excitation coil provided arranged in the fixing device with a driving signal of a pulse-width modulation (PWM) signal. An electric power control is performed by changing a driving frequency of the PWM signal in a frequency range equal to or higher than a resonant frequency (resonance point) which is determined by capacitance of a resonant capacitor within an electric power source and inductance of the excitation coil of the fixing device. There is a technique available for performing electric power control by adjusting a PWM driving frequency so that electric power becomes a maximum value set by a central processing unit (CPU) at the time of warm-up (from when the power was turned on until when temperature reaches a set value of temperature control), and when a target temperature is reached, keeping the temperature constant by changing the PWM driving frequency (e.g., Japanese Patent Application Laid-Open No. 2000-223253).

In the control of the electromagnetic induction heating type device using the PWM control, a relationship of an input power PW of the power source varies according to a PWM driving frequency f as illustrated in FIG. 12. More specifically, it has a characteristic in which, a maximum electric power PWp is supplied when a driving frequency is at a resonant frequency fpy, and an electric power is reduced when the frequency changes to a high-frequency side or a low-frequency side centered on the resonant frequency fpy. The electric power control can be performed by controlling the driving frequency f of the PWM driving signal by utilizing this characteristic.

The input power takes a maximum value at the resonant frequency fpy. Constants of the resonant capacitor and the coil within the fixing device are determined so that the resonant frequency fpy becomes 15 to 20 KHz. If a load inductance value of the fixing device is L1 and a capacitance value of the resonant capacitor is C1, the resonant frequency fpy is expressed by the following equation.

$$fpy=\frac{1}{2\pi\sqrt{L1\times C1}} \quad \text{[Equation 1]}$$

A range of the driving frequencies of the PWM driving signals is generally 20 to 100 KHz, and it is used at frequencies equal to or greater than the resonant frequency fpy. There is a problem that the driving frequency enters into an audible field at equal to or less than 20 KHz, and it is felt as noise. Accordingly, a minimum driving frequency is set to 20 KHz. On the other hand, the maximum driving frequency is set to 100 KHz from a relationship of Radio Act of Japan. At the time of electric power control, if an electric power to be supplied to the excitation coil does not reach a target power PWo, the PWM driving signal continues to be driven in a state where the driving frequency of the PWM driving signals is a minimum frequency.

When a fixing roller serving as an electrically conductive heating element is made of an alloy having characteristics in which magnetic permeability is large at a low temperature, and the magnetic permeability becomes small with increase in temperature, an inductor value of a load becomes small when the fixing roller is at a high temperature. Therefore, when a temperature of the fixing roller becomes high, the characteristic of the fixing roller is changed, and the resonant frequency fpy becomes high. At this time, if the driving frequency remains constant, the driving frequency will become lower than the resonant frequency fpy after fluctuation. As a result, as illustrated in FIG. 12, a problem arises that the input power decreases, and a time until the temperature of the fixing roller reaches a target temperature becomes longer.

On the other hand, if the driving frequency is set high from the a state that the temperature of the fixing roller is low, in anticipation of a change in the resonant frequency, there is a problem that the target power cannot be supplied to the excitation coil at a low temperature, and the time until the fixing roller reaches the target temperature becomes longer.

SUMMARY OF THE INVENTION

According to an aspect of the present invention, an apparatus including a fixing device which fixes a toner image transferred onto a sheet by causing a heating element to generate heat using an induction heating method includes an induction coil configured to generate a magnetic field for induction heating, a resonant capacitor connected to the induction coil, a switching element configured to supply electric power to the induction coil, a driving signal generation circuit configured to determine a frequency of a driving signal for driving the switching element according to the supplied electric power and to generate the driving signal, a temperature detection unit configured to detect a temperature of the heating element, and a setting unit configured to set a minimum frequency of the driving signal according to the detected temperature so that a frequency of the generated driving signal does not become lower than a resonant frequency determined by an inductance of the induction coil and an inductance of the heating element and a capacitance of the resonant capacitor.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1:
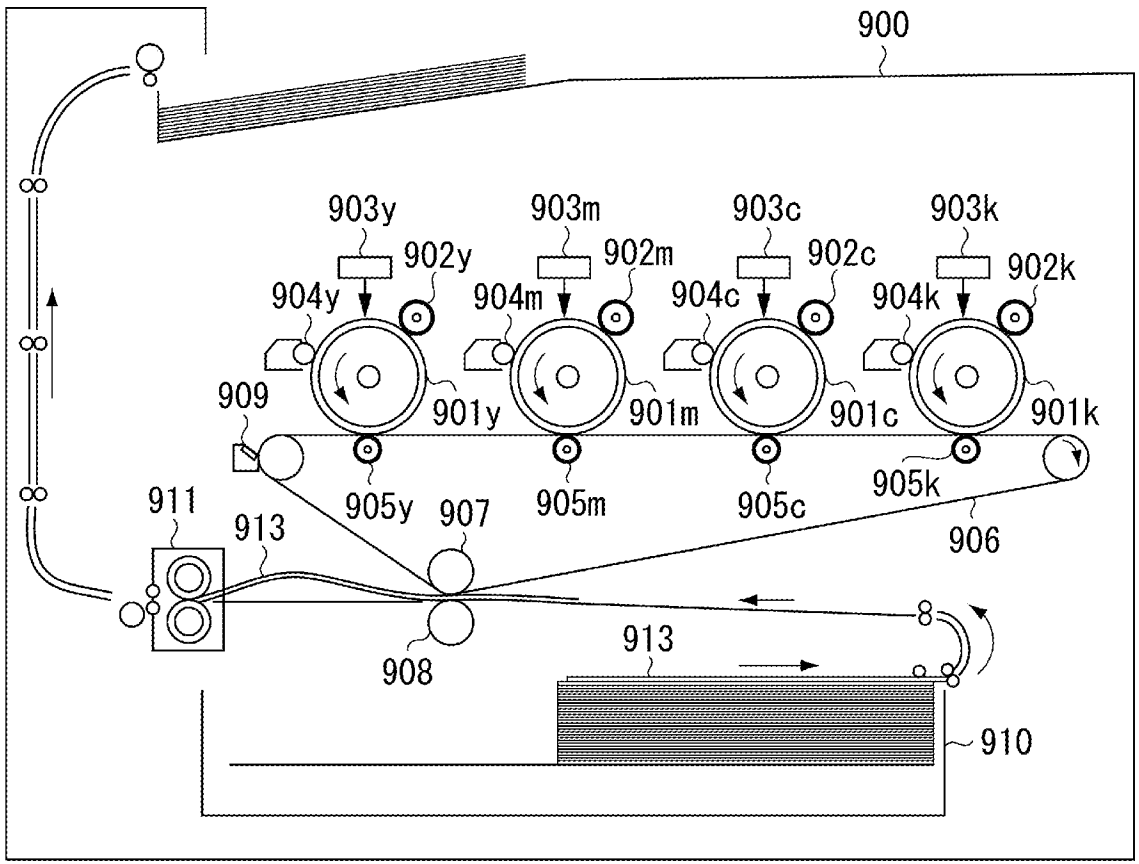
FIG. 1 is a cross-sectional view illustrating a configuration of an image forming apparatus.

FIG. 1 is a schematic configuration diagram of an image forming apparatus. In FIG. 1, an image forming apparatus 900 includes image forming units for yellow (y), magenta (m), cyan (c), and black (k). The image forming unit for yellow will be described. A photosensitive drum 901*y* (photosensitive member) rotates in a counterclockwise direction, and a primary charging roller 902*y* uniformly charges a surface of the photosensitive drum 901*y*. The uniformly charged surface of the photosensitive member 901*y* is irradiated with a laser beam from a laser unit 903*y*, and a latent image is formed on the surface of the photosensitive member 901*y*. The formed electrostatic latent image is developed with a yellow toner by a development device 904*y*. Then, the yellow toner image developed on the photosensitive member 901*y* is transferred onto a surface of an intermediate transfer belt 906 by voltage being applied to a primary transfer roller 905*y*.

In a similar manner, toner images of magenta, cyan, and black are transferred onto the surface of the intermediate transfer belt 906. In this way, a full-color toner image formed of yellow, magenta, cyan, and black toners is formed on the intermediate transfer belt 906. Then, the full-color toner image formed on the intermediate transfer belt 906 is transferred onto a sheet 913 fed from a cassette 910 at a nip portion between secondary transfer rollers 907 and 908. The sheet 913 which has passed through the secondary transfer rollers 907 and 908 is conveyed to the fixing device 911 to be applied heat and pressure, and thus the full-color image is fixed on the sheet 913.

Figure 2:
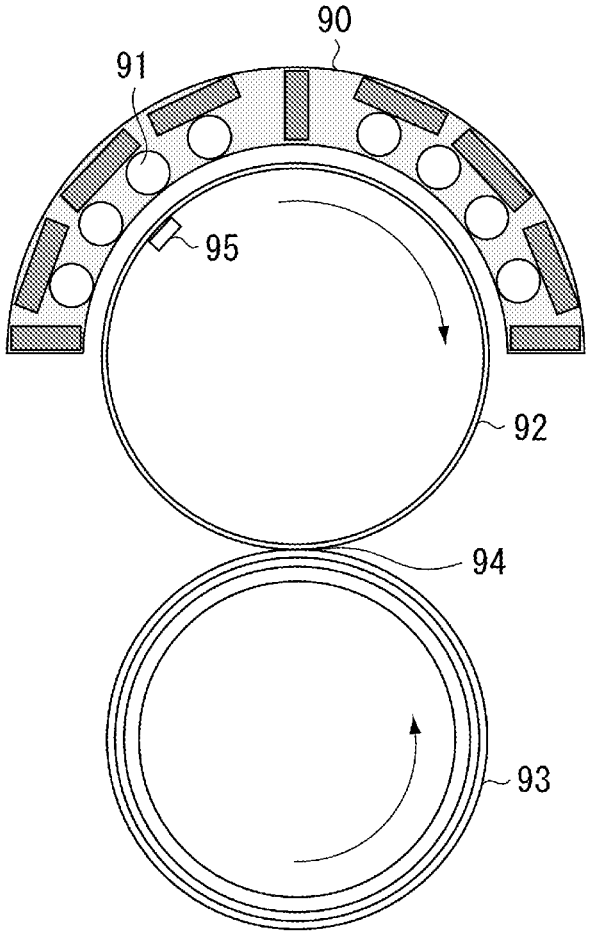
FIG. 2 is a cross-sectional view illustrating a configuration of a fixing device.

FIG. 2 is cross-sectional view illustrating a schematic configuration of the fixing device 911 using the electromagnetic induction heating method. A fixing roller 92 is formed by an electrically conductive heating element made of a metal with a thickness of 45 μm, and its surface is covered by a 300 μm rubber layer. Rotation of a driving roller 93 is transmitted via a nip portion 94 to the fixing roller 92, so that the fixing roller 92 rotates in the direction indicated by an arrow. An electromagnetic induction coil 91 is disposed within a coil holder 90 at a position facing to the fixing roller 92, and a power source (not illustrated) applies an alternating current (AC) current to the electromagnetic induction coil 91 to produce a magnetic field, so that the electrically conductive heating element of the fixing roller 92 generates heat by itself. A thermistor 95 as a temperature detection means abuts on a heat generating portion of the fixing roller 92 from inner side, and detects a temperature of the fixing roller 92.

Figure 3:
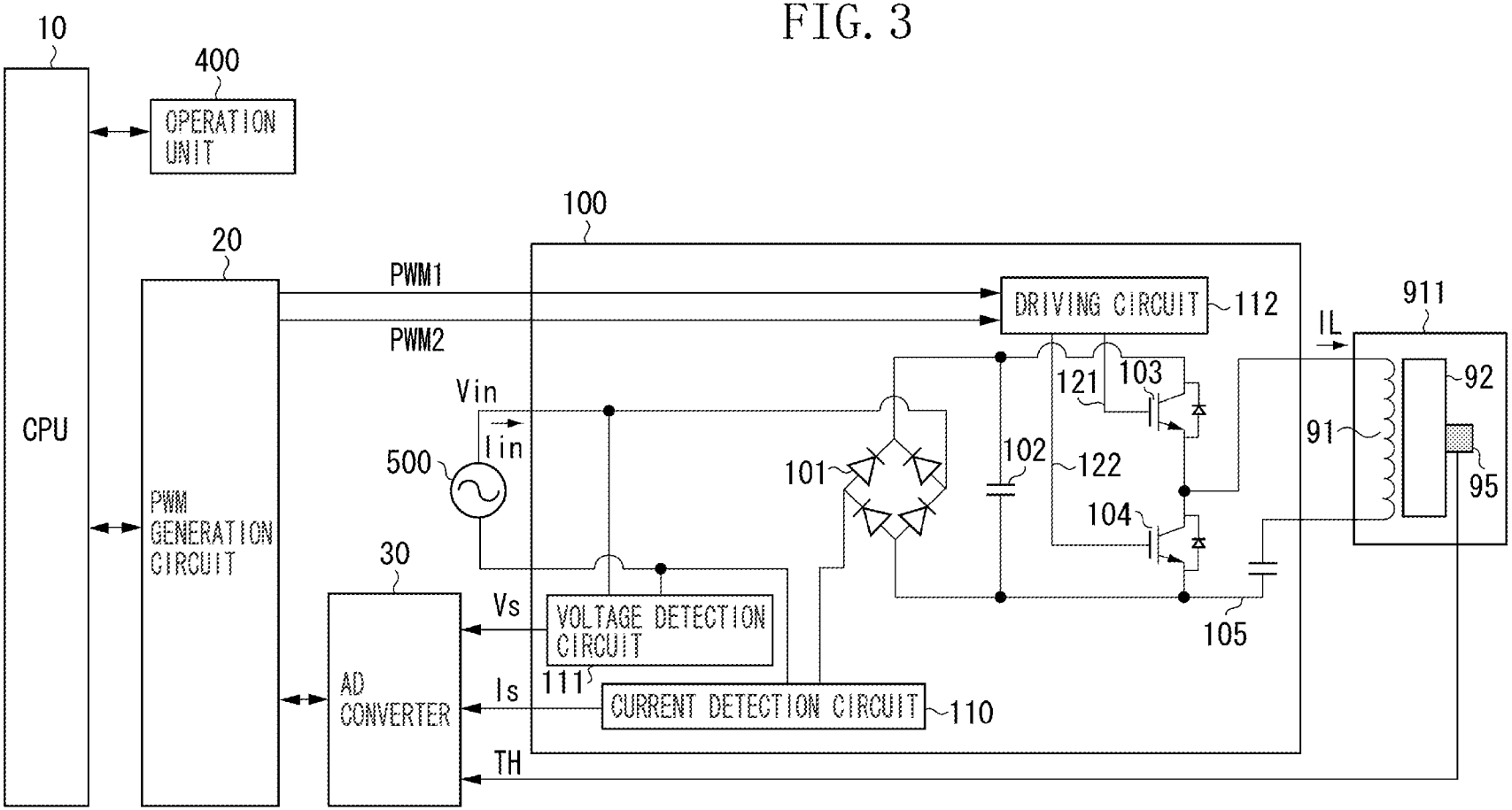
FIG. 3 is a configuration diagram of a temperature control circuit according to a first exemplary embodiment of the present invention.

FIG. 3 illustrates a temperature control circuit of the fixing device using the electromagnetic induction heating method according to the first exemplary embodiment.

A power source 100 includes a diode bridge 101, a smoothing capacitor 102, and first and second switching elements 103 and 104. The power source 100 rectifies and smoothes an AC current from an AC commercial power source 500, and supplies it to the switching elements 103 and 104. The power source 100 further includes a resonant capacitor 105 that forms a resonant circuit in conjunction with the electromagnetic induction coil 91, and a driving circuit 112 that outputs driving signals of the switching elements 103 and 104.

The power source 100 further includes a current detection circuit 110 that detects an input current Iin, and a voltage detection circuit 111 that detects an input voltage Vin. The input current Iin and the input voltage Vin take values matched to the electric power supplied to the electromagnetic induction coil 91.

A CPU 10 performs overall control of the image forming apparatus 900, and sets a target temperature To of the fixing roller 92 within the fixing device 911 and a maximum pulse width (upper limit value) ton (max) of the PWM signal corresponding to the driving frequency of the switching elements 103 and 104 to a PWM generation circuit 20. A maximum pulse width ton (max) of the PWM signal is set so as not to exceed a pulse width corresponding to the resonant frequency.

The CPU 10 further sets a minimum frequency Fmin (maximum pulse width), a maximum frequency Fmax (minimum pulse width) of the driving signals of the switching elements 103 and 104, and a maximum power used in the fixing device 911 to the PWM generation circuit 20. The minimum frequency Fmin may be a resonant frequency, but becomes a frequency somewhat higher than the resonant frequency, in anticipation of safety, so that a frequency of the driving signals described below may not fall below the resonant frequency.

The PWM generation circuit 20 inputs a detected value TH of a surface temperature of the fixing roller 92 detected using the thermistor 95, a detected current value Is of the current detection circuit 110, and a detected value Vs of the voltage detection circuit 111 via an analog-to-digital (AD) converter 30. Then, the PWM generation circuit 20 determines signals PWM1 and PWM2 corresponding to pulse widths of driving signals 121 and 122 output from the driving circuit 112 based on a difference between the detected value TH and the target value.

The driving circuit 112 performs level conversion on the signals PWM1 and PWM2 into the driving signals 121 and 122. In other words, the PWM generation circuit 20 and the driving circuit 112 act as driving signal generating means. The switching elements 103 and 104 are alternately switched ON and OFF in accordance with the driving signals 121 and 122, and supply a high-frequency electric current IL to the electromagnetic induction coil 91.

ON-width and OFF-width of pulses of the driving signals 121 and 122 are equal to each other, and the ON-width of pulse of the driving signal 121 and the ON-width of pulse of the driving signal 122 are also set equal to each other, which take a duty ratio of 50%. Therefore, as the ON-width of pulse is widened, the OFF-width is also widened by the same amount, and thus a frequency of the driving signals becomes low.

Increase or decrease of the high-frequency current IL is proportional to strength of a generated magnetic field, and as the high-frequency current IL is increased or decreased, a heating value of the electrically conductive heating element is increased or decreased. Accordingly, the PWM generation circuit 20 can control the temperature of the fixing roller 92 by adjusting a frequency (pulse width) of the high-frequency current IL.

An operation unit 400 includes a display device that displays keys or information for receiving an instruction from an operator.

The input current Iin is increased as the pulse width is widened and decreased as the pulse width is narrowed in a range of pulse widths which are narrower than a pulse width of the resonant frequency that is determined from inductance values of the electromagnetic induction coil 91 and the fixing roller 92 and a capacitance value of the resonant capacitor 105. More specifically, in a frequency equal to or greater than the minimum frequency, the input current Iin is increased as a frequency of the driving signal becomes low, and the input current Iin is decreased as the frequency becomes high.

The high-frequency current IL which flows through the electromagnetic induction coil 91 is similar to the input current Iin. Increase or decrease of the high-frequency current IL is proportional to the strength of the generated magnetic field, and as the high-frequency current IL is increased or decreased, the heating value of the electrically conductive heating element is increased or decreased. Accordingly, the PWM generation circuit 20 can control the temperature of the fixing roller 92 by adjusting the frequency (pulse width) of the high-frequency current IL.

The fixing roller 92 is formed of a magnetic shunt alloy (magnetic material) having a Curie temperature (e.g., 230° C.). The magnetic shunt alloy has characteristics in which, when the temperature rises and reaches the Curie temperature, its magnetism drops sharply. The Curie temperature is a temperature at which magnetic material completely loses its magnetism.

In a magnetic material, a direction of a magnetic moment of atoms which are arrayed in the same direction at a low temperature, begins to fluctuate by an influence of thermal energy when the temperature is raised. For this reason, the entire magnetic moment is decreased little by little. When the temperature is further raised, decrease in magnetization rapidly advances, and the direction of the magnetic moment is completely disrupted at a temperature equal to or higher than the Curie temperature, and accordingly spontaneous magnetization becomes zero.

Figure 4:
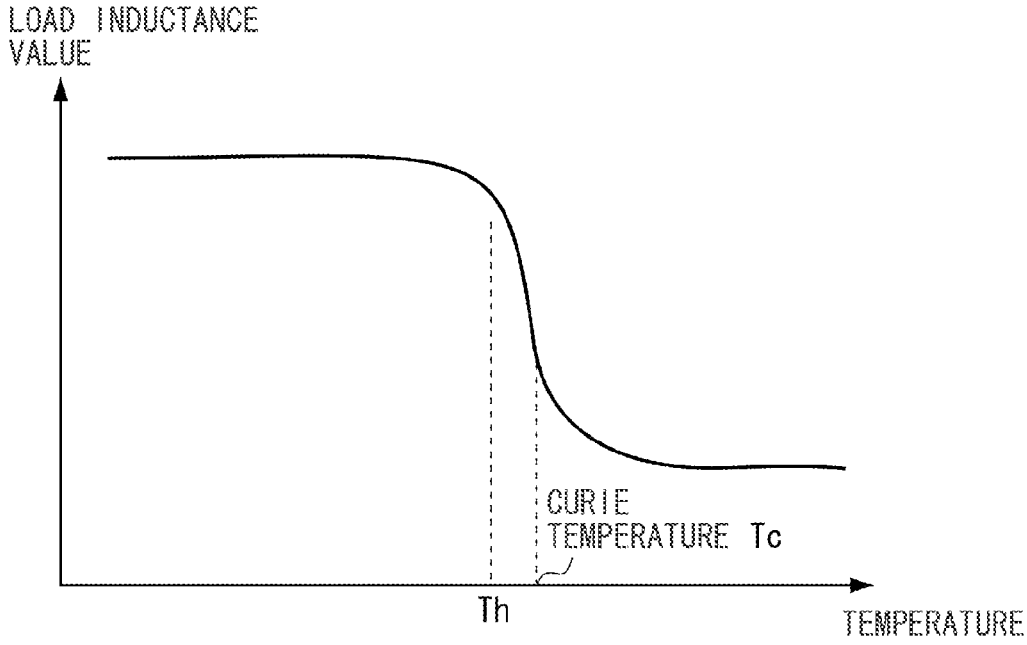
FIG. 4 illustrates a relationship between temperature and load inductance of a fixing roller.

When a temperature of the fixing roller 92 changes, a load inductance of the fixing roller 92 as viewed from the power source changes as illustrated in FIG. 4. Since the fixing roller 92 keeps its magnetism, when the temperature of the fixing roller 92 is less than a temperature Th which is lower than the Curie temperature Tc, the load inductance of the fixing roller 92 as viewed from the power supply device 100 is 15 to 20 μH.

If the fixing roller 92 is heated and the temperature becomes closer to the temperature Th, the load inductance of the fixing roller 92 as viewed from the power supply device 100 is decreased gradually. Then, the load inductance of the fixing roller 92 as viewed from the power supply device 100 falls sharply near the temperature Th. After the temperature of the fixing roller 92 exceeds the Curie temperature, the load inductance of the fixing roller 92 as viewed from the power supply device 100 converges on a substantially constant value.

Figure 5:
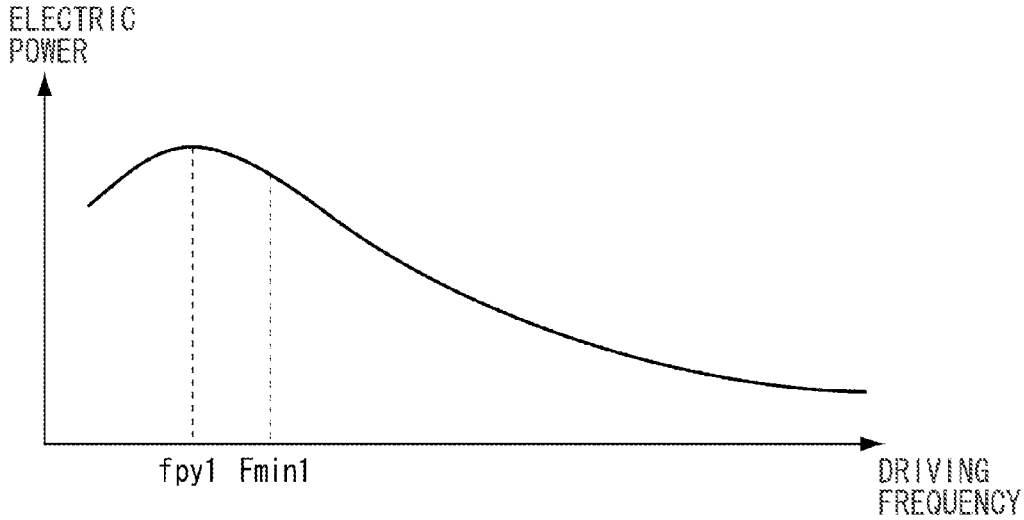
FIG. 5 illustrates a relationship between input power and driving frequency when a temperature of the fixing roller is low.

FIG. 5 illustrates a relationship between input power and driving frequency, when the temperature of the fixing roller 92 is less than the temperature Th. If a frequency is fixed to a minimum value Fmin1 of the driving frequencies, a resonant frequency fpy1 at this time becomes smaller than the minimum frequency Fmin1. The temperature Th is lower than a target temperature when the fixing device fixes a toner image onto a sheet. Therefore, in the process in which the temperature of the fixing roller 92 reaches the target temperature for a fixing operation, the inductance of the fixing roller 92 is sharply decreased.

Figure 6:
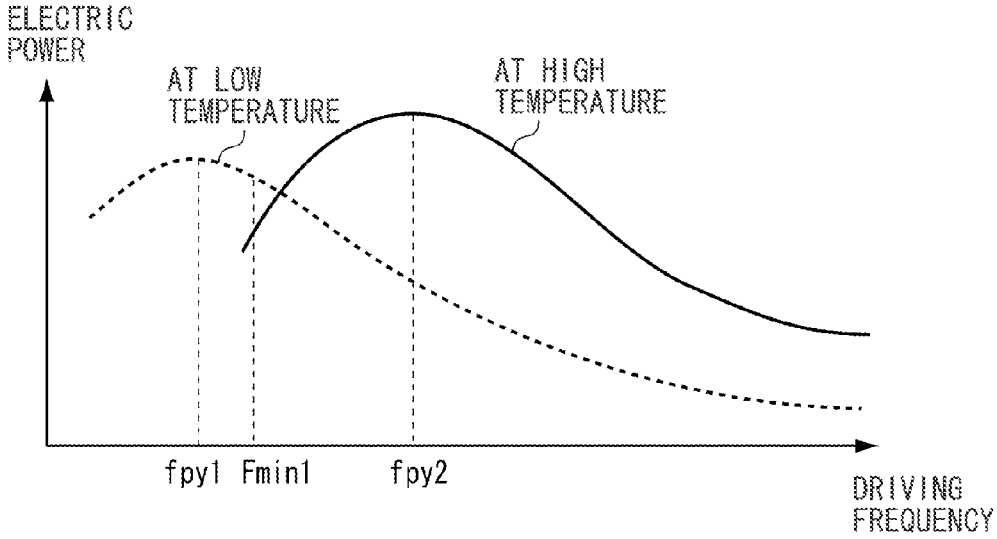
FIG. 6 illustrates a relationship among temperature, input power, and driving frequency of the fixing roller.

FIG. 6 illustrates a relationship between input power and driving frequency, when the temperature of the fixing roller 92 is equal to or higher than the temperature Th. As illustrated in FIG. 4, the inductance of the fixing roller 92 as viewed from the power supply device 100 drops near the temperature Th. Therefore, a resonant frequency fpy2 at this time becomes larger than the minimum value Fmin1 of the driving frequency.

As a result, when first and second switching elements 103 and 104 drive at the minimum frequency Fmin1, the first and second switching element 103 and 104 will operate at a frequency lower than the resonant frequency fpy2 at high temperature. As a result, the input power to the power supply device 100 is decreased, and thus the fixing roller 92 takes longer time to reach the target temperature.

Figure 7:
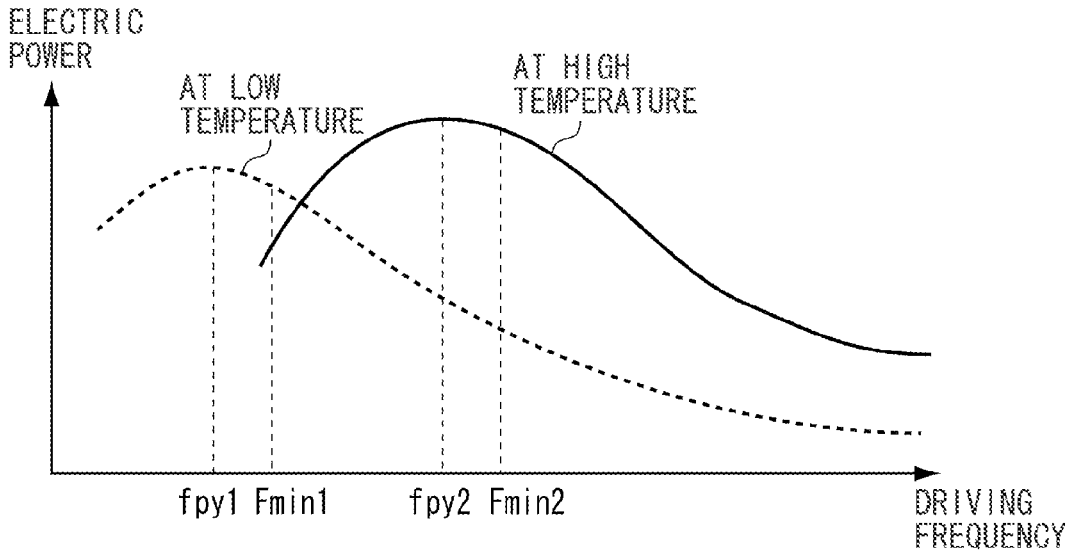
FIG. 7 illustrates a relationship among temperature, input power, and driving frequency of the fixing roller.

Thus, in the present exemplary embodiment, it is considered to change a minimum frequency of the PWM signals 1 and 2 according to a temperature detected by the thermistor 95 (see FIG. 7).

Figure 8:
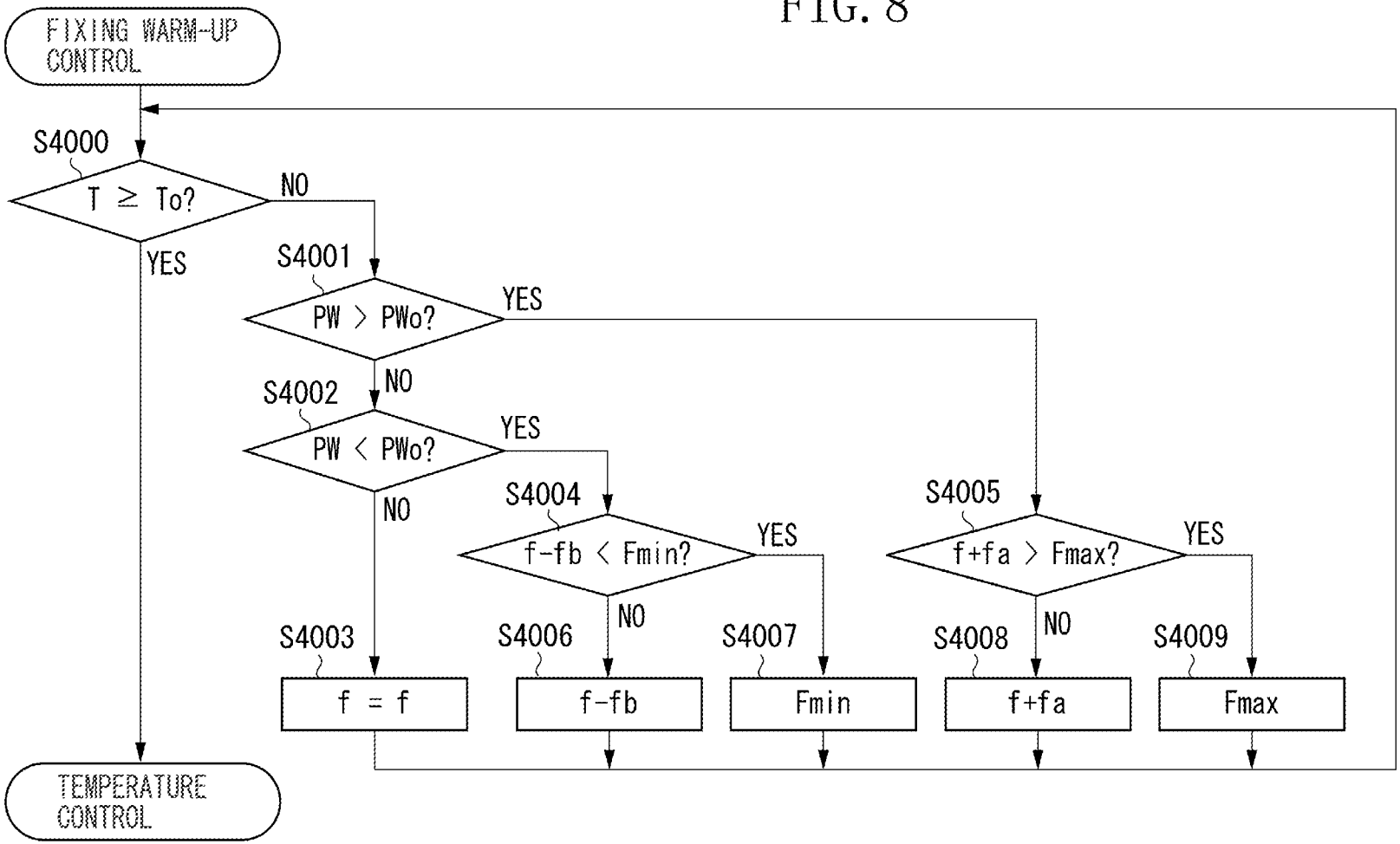
FIG. 8 is a flowchart illustrating electric power control at the time of warm-up of the fixing device.

A control operation of the temperature control circuit at the time of warm-up of the fixing device by the PWM generation circuit 20 will be described with reference to the flowchart in FIG. 8. FIG. 8 illustrates frequency control when electric power to be supplied to the electromagnetic induction coil 91 is controlled.

In step S4000, the PWM generation circuit 20 determines whether a temperature T detected by the thermistor 95 is equal to or higher than a target temperature To. If the detected temperature T is equal to or higher than the target temperature To (YES in step S4000), the processing shifts to temperature control described below. On the other hand, if the detected temperature T is less than the target temperature To (NO in step S4000), the processing proceeds to step S4001. In steps S4001 and S4002, the PWM generation circuit 20 compares input power PW obtained from outputs Vs and Is of the voltage detection circuit 111 and the current detection circuit 110 with target power PWo.

If the input power PW is greater than the target power PWo (YES in step S4001), then in step S4005, the PWM generation circuit 20 determines whether a value obtained by raising the driving frequency f of the PWM signals 1 and 2 by a predetermined value fa exceeds a maximum frequency Fmax. If the value f+fa does not exceed the maximum frequency Fmax (NO in step S4005), then in step S4008, the frequency is raised by the predetermined value fa. On the other hand, if the value f+fa exceeds the maximum frequency Fmax (YES in step S4005), then in step S4009, the PWM generation circuit 20 sets the driving frequency to Fmax.

In step S4002, if the input power PW is less than the target power PWo (YES in step S4002), then in step S4004, the CPU 400 determines whether a value obtained by decreasing the driving frequency f by a predetermined value fb is lower than the minimum frequency Fmin. If the value f−fb is not less than the minimum frequency Fmin (NO in step S4004), then in step S4006, the frequency is decreased by the predetermined value fb. On the other hand, if the value f−fb is less than the minimum frequency Fmin (YES in step S4004), then in step S4007, the PWM generation circuit 20 sets the driving frequency to Fmin.

If the input power PW is equal to the target power PWo (NO in steps S4001 and S4002), then in step S4003, the PWM generation circuit 20 maintains the driving frequency f. At the time of the warm-up of the fixing device when the image forming apparatus is powered on, the electric power to be supplied to the fixing device becomes extremely large. Therefore, the driving frequency is determined while comparing the electric power so that the electric power to be supplied does not exceed the target power.

The PWM generation circuit 20 may perform control by hardware logic, instead of control by software.

Figure 9:
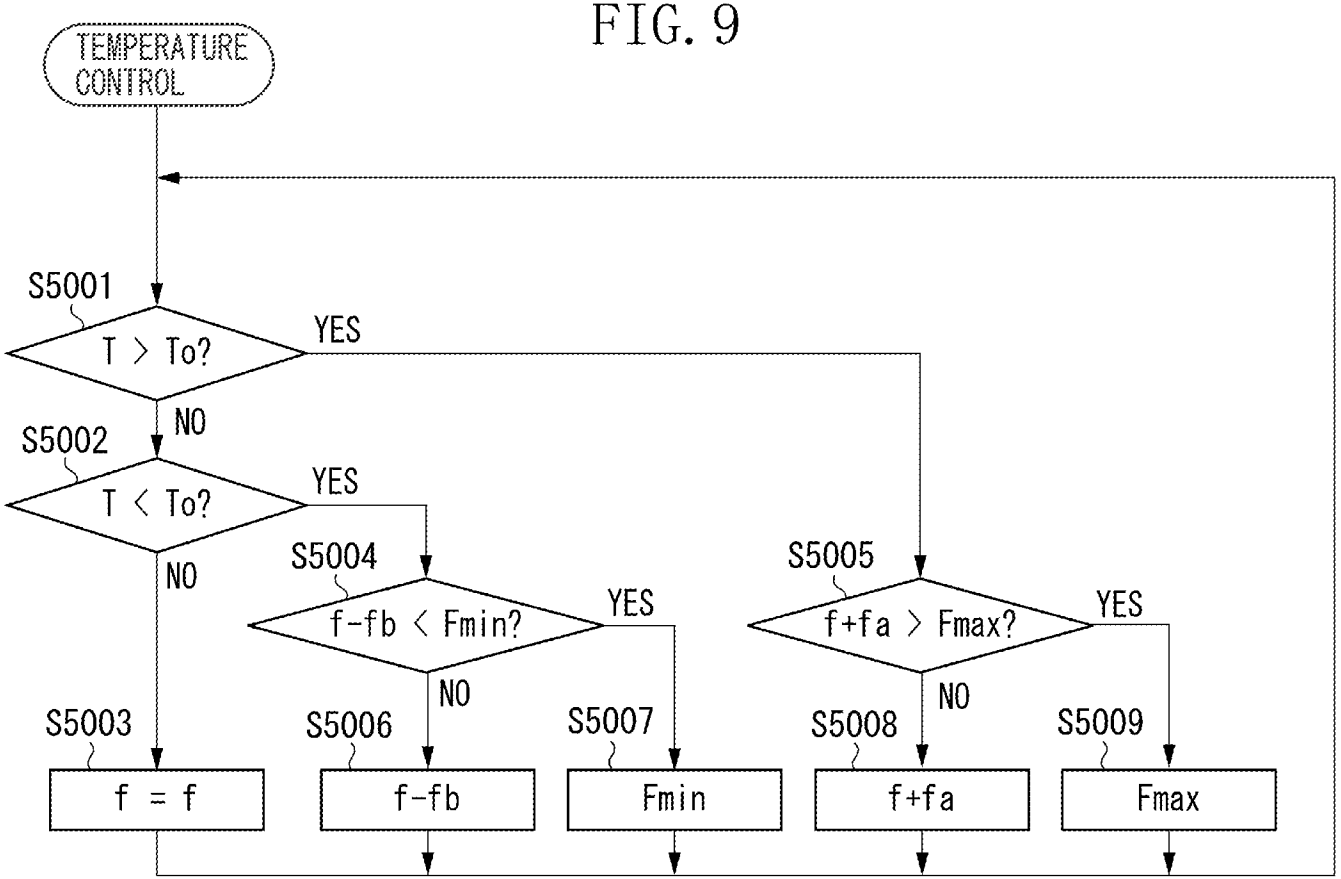
FIG. 9 is a flowchart illustrating temperature control of the fixing device.

Next, frequency control at the time of temperature control will be described with reference to the flowchart in FIG. 9. In steps S5001 and S5002, the PWM generation circuit 20 compares a temperature T of the fixing roller 92 detected by the thermistor 95 with the target temperature To.

If the temperature T is greater than the target temperature To (YES In step S5001), then in step S5005, the PWM generation circuit 20 determines whether a value obtained by raising the driving frequency f of the PWM signals 1 and 2 by the predetermined value fa exceeds the maximum frequency Fmax. If the value f+fa does not exceed the maximum frequency Fmax (NO in step S5005), then in step S5008, the frequency is raised by the predetermined value fa. On the other hand, if the value f+fa exceeds the maximum frequency Fmax (YES in step S5005), then in step S5009, the PWM generation circuit 20 sets the driving frequency to Fmax.

If the temperature T is less than the target temperature To (YES in step S5002), then in step S5004, the PWM generation circuit 20 determines whether a value obtained by decreasing the driving frequency f by the predetermined value fb is lower than the minimum frequency Fmin. If the value is not less than the minimum frequency Fmin (NO in step S5004), then in step S5006, the frequency is decreased by the predetermined value fb. On the other hand, if the value f−fb is less than the minimum frequency Fmin (YES in step S5004), then in step S5007, the PWM generation circuit 20 sets the driving frequency to Fmin.

If the temperature T is equal to the target temperature To (NO in steps S5001 and S5002), then in step S5003, the PWM generation circuit 20 maintains the driving frequency f.

Figure 10:
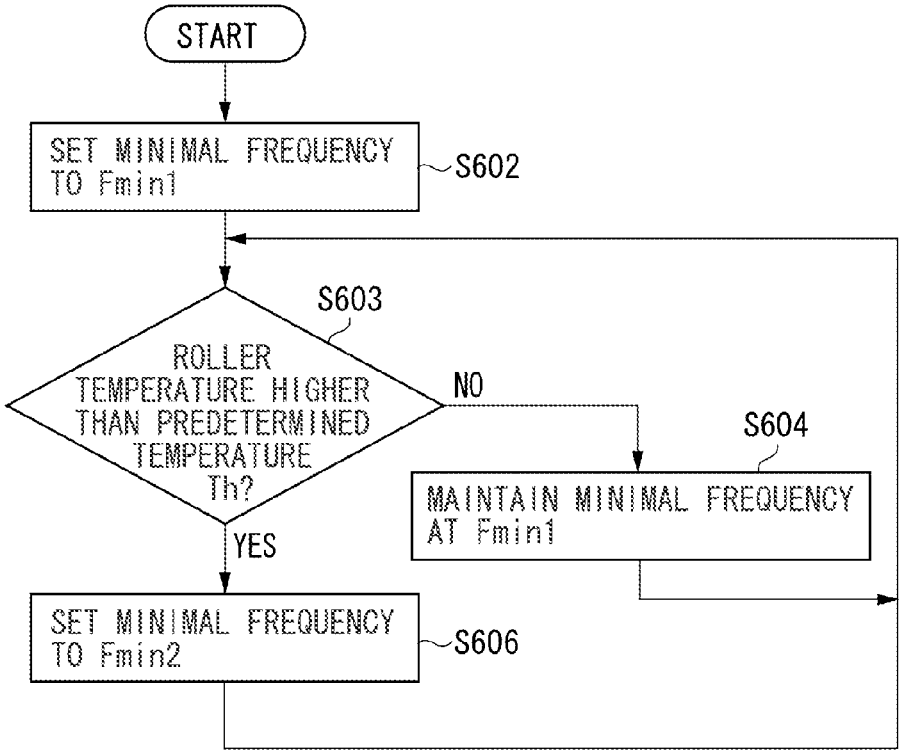
FIG. 10 is a flowchart illustrating determination processing of a minimum driving frequency according to the first exemplary embodiment.

Subsequently, an operation for changing the minimum frequency Fmin will be described with reference to FIG. 10. Processing illustrated in the flowchart is executed by the CPU 10.

First, in step S602, the CPU 10 sets the minimum frequency of the PWM signals 1 and 2 to Fmin1, and notifies the PWM generation circuit 20 of the setting.

The CPU 10 always monitors the temperature of the fixing roller 92 by the thermistor 95. In step S603, the CPU 10 determines whether the temperature of the fixing roller 92 has become equal to or higher than the predetermined temperature Th. The predetermined temperature Th is a threshold value for switching the minimum frequency, and is lower than the target temperature To.

Until the fixing roller 92 is heated and the temperature of the fixing roller 92 reaches the predetermined temperature Th (NO in step S603), in step S604, the CPU 10 maintains the minimum frequency at Fmin1.

When the temperature of the fixing roller 92 becomes equal to or higher than the predetermined temperature Th (YES in step S603), then in step S606, the CPU 10 changes the minimum frequency to Fmin2 (>Fmin1), and notifies the PWM generation circuit 20 of the changed minimum frequency. The PWM generation circuit 20 determines the frequency of the PWM signals 1 and 2 so as not to become lower than the minimum frequency notified from the CPU 20.

In this case, the minimum frequency Fmin2 is set to a value which does not fall below a resonant frequency fpy determined from the load inductance of the fixing roller 92 when the temperature of the fixing roller 92 is Th and the capacitance of the resonant capacitor 105. It becomes possible to cause the switching elements 103 and 104 to perform the switching operation at the frequency equal to or higher than the resonant frequency fpy, by changing the minimum frequency Fmin of the PWM signals 1 and 2 along with temperature rise of the fixing roller 92.

By performing the processing as described above, the driving frequency of the driving signals 121 and 122 always becomes equal to or higher than the resonant frequency during the operation of the induction heating. As a result, a problem that the input power of the power supply device 100 is decreased can be avoided, if the temperature of the fixing roller 92 is raised and the characteristic thereof is changed.

In a second exemplary embodiment, there is described a case in which temperatures to switch the minimum frequency are taken at two stages of temperatures Th1 and Th2. Since the second exemplary embodiment is similar to the first exemplary embodiment except for processing for switching the minimum frequency, an operation for switching the minimum frequency will be described here.

Figure 11:
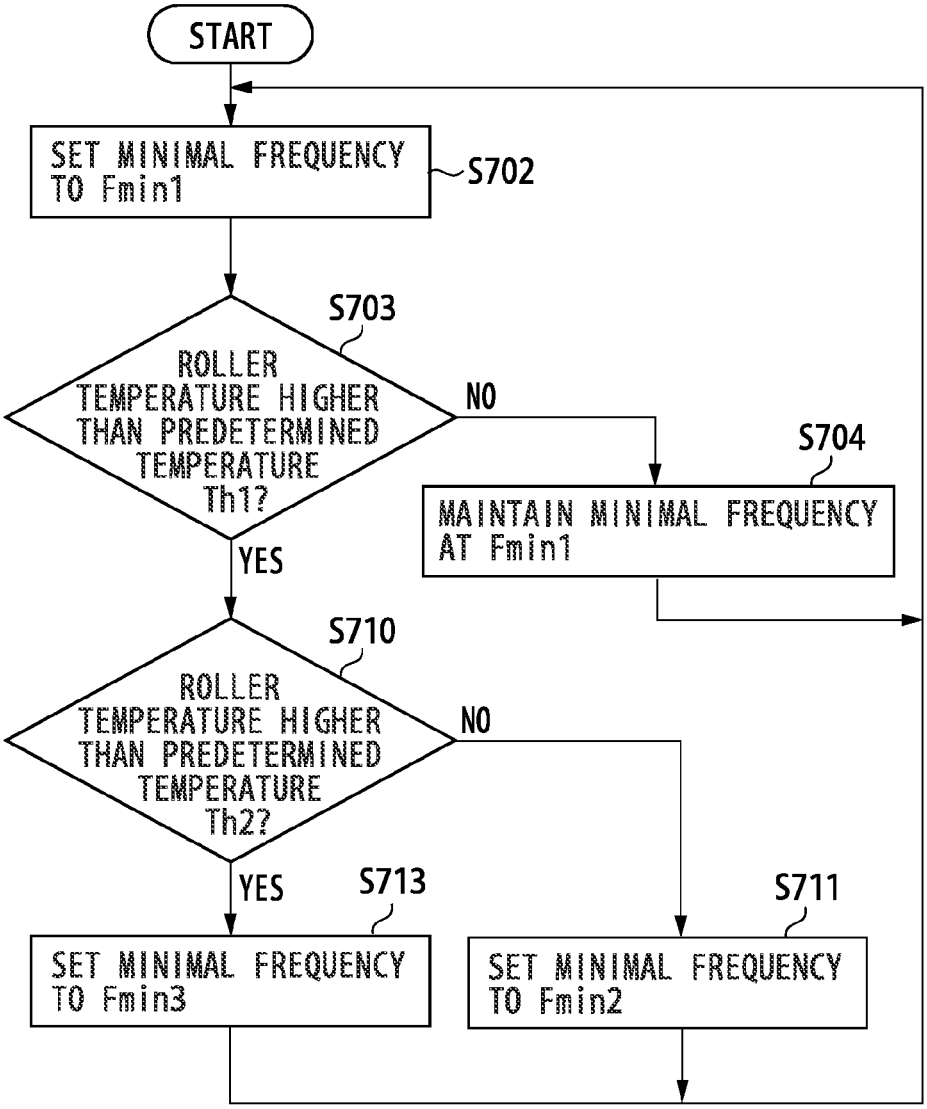
FIG. 11 is a flowchart illustrating determination processing of a minimum driving frequency according to a second exemplary embodiment.
Figure 12:
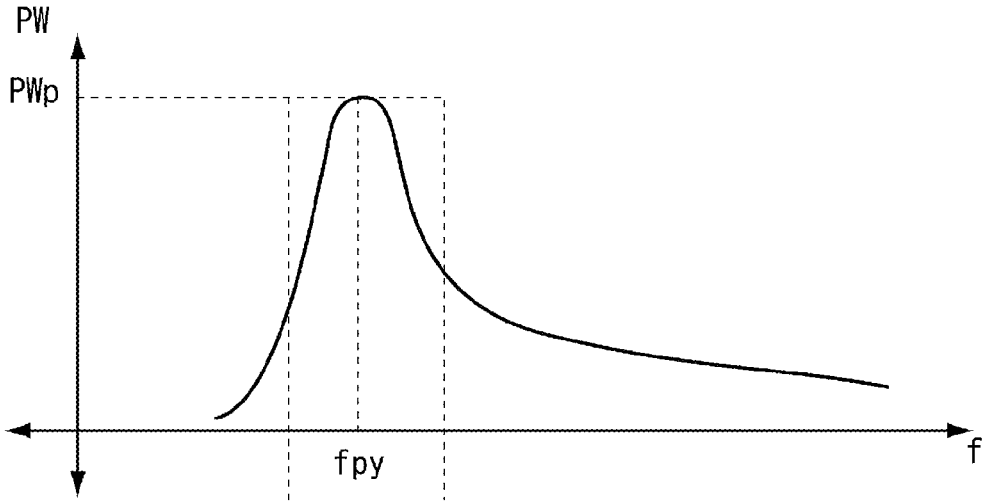
FIG. 12 illustrates a relationship between driving frequency and supplied power.

An operation of the CPU 10 for switching the minimum frequency will be described with reference to FIG. 11. First, in step S702, the CPU 10 sets the minimum frequency to Fmin1, and notifies the PWM generation circuit of the setting.

The CPU 10 always monitors the temperature of the fixing roller 92. In step S703, the CPU 10 determines whether the temperature of the fixing roller 92 is equal to or higher than a predetermined temperature Th1. Until the temperature of the fixing roller 92 exceeds the predetermined temperature Th1 (NO in step S703), in step S704, the CPU 10 maintains a setting value of the minimum frequency of the PWM signals 1 and 2 at Fmin1.

If the temperature of the fixing roller 92 is equal to or higher than the predetermined temperature Th1 (YES in step S703), then in step S710, the CPU 10 determines whether the temperature of the fixing roller 92 is equal to or higher than a predetermined temperature Th2. If the temperature of the fixing roller 92 is less than the predetermined temperature Th2 (NO in step S710), then in step S711, the CPU 10 sets the minimum frequency to Fmin2 (>Fmin1), and notifies the PWM generation circuit 20 of the setting. If the temperature of the fixing roller 92 is equal to higher than the predetermined temperature Th2 (YES in step S710), then in step S713, the CPU 10 sets the minimum frequency to Fmin3 (>Fmin2), and notifies the PWM generation circuit 20 of the setting.

In this case, the minimum frequencies Fmin2 and Fmin3 are set to values which do not fall below the resonance frequencies fpy1 and fpy2 determined from inductances of the fixing roller 92 when the fixing roller 92 is at the temperatures Th1 and Th2 and a capacitance of the resonant capacitor 105, respectively.

By providing three stages to the switching of the minimum frequencies, more delicate electric power control can be realized in comparison with the first exemplary embodiment. The switching stages of the minimum frequencies may be four or more stages.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2010-052023 filed Mar. 9, 2010, which is hereby incorporated by reference herein in its entirety.

What is claimed is:

1. An apparatus including a fixing device which fixes a toner image transferred onto a sheet by causing a heating element, consisting of a magnetic material which has a characteristic that a magnetic property decreases at a temperature higher than a Curie temperature, to generate heat using an induction heating method, the apparatus comprising:

an induction coil configured to generate a magnetic field for induction heating;

a resonant capacitor connected to the induction coil;

a switching element configured to supply electric power to the induction coil;

a driving signal generation circuit configured to determine a frequency of a driving signal for driving the switching element according to the supplied electric power so that a frequency of the driving signal does not become lower than a received data corresponding to a lower limit of the frequency and to generate the driving signal;

a temperature detection unit configured to detect a temperature of the heating element; and a setting unit configured to set a lower limit of the frequency of the driving signal generated by the driving signal generation circuit according to the detected temperature so that a frequency of the driving signal does not become lower than a resonant frequency determined by an inductance of the induction coil and an inductance of the heating element, the inductance being variable according to a temperature, and a capacitance of the resonant capacitor, and to transmit data corresponding to the lower limit of the frequency of the driving signal to the driving signal generation circuit.

2. The apparatus according to claim 1, wherein the setting unit is configured to set the lower limit of the frequency to a first frequency in a case where the detected temperature is equal to or lower than a predetermined temperature lower than the Curie temperature and set the lower limit of the frequency to a second frequency higher than the first frequency in a case where the detected temperature is higher than the predetermined temperature.

3. The apparatus according to claim 2, wherein the predetermined temperature is a temperature lower than the Curie temperature.

4. The apparatus according to claim 3, wherein the predetermined temperature is a temperature lower than a target temperature at which the fixing device fixes the toner image onto a sheet.

5. The apparatus according to claim 2, wherein the second frequency is higher than a resonant frequency determined by an inductance of the induction coil, a capacitance of the resonant capacitor, and an inductance of the heating element when a temperature of the heating element is equal to the predetermined temperature.

6. The apparatus according to claim 5, wherein the first frequency is higher than a resonant frequency determined by the inductance of the induction coil, the capacitance of the resonant capacitor, and an inductance of the heating element when the temperature of the heating element is lower than the predetermined temperature.

* * * * *